US006776592B2

(12) United States Patent
Nakane et al.

(10) Patent No.: US 6,776,592 B2
(45) Date of Patent: Aug. 17, 2004

(54) SCROLL TYPE COMPRESSOR

(75) Inventors: Yoshiyuki Nakane, Kariya (JP); Kazuho Sato, Kariya (JP); Tsutomu Nasuda, Kariya (JP); Hisao Hamasaki, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 0 days.

(21) Appl. No.: 10/630,391

(22) Filed: Jul. 30, 2003

(65) Prior Publication Data

US 2004/0067147 A1 Apr. 8, 2004

(30) Foreign Application Priority Data

Aug. 5, 2002 (JP) ..... P2002-227482

(51) Int. Cl.[7] ..... F04C 18/00
(52) U.S. Cl. ..... 418/55.2; 418/55.1; 418/83
(58) Field of Search ..... 418/55.2, 55.1, 418/83

(56) References Cited

U.S. PATENT DOCUMENTS 4,490,099 A * 12/1984 Terauchi et al. ..... 418/55.2
6,193,488 B1 * 2/2001 Kamiya et al. ..... 418/55.2

FOREIGN PATENT DOCUMENTS

| | | | | |
|---|---|---|---|---|
| JP | 57062988 A | * | 4/1982 | ..... F04C/18/04 |
| JP | 58013184 A | * | 1/1983 | ..... F04C/18/02 |
| JP | 58172405 A | * | 10/1983 | ..... F01C/1/02 |
| JP | 5-231350 | | 9/1993 | |
| JP | 06173867 A | * | 6/1994 | ..... F04C/18/02 |
| JP | 11-257259 | | 9/1999 | |

* cited by examiner

*Primary Examiner*—Theresa Trieu
(74) *Attorney, Agent, or Firm*—Knoble Yoshida & Dunleavy

(57) ABSTRACT

In a region where heat deformation of a movable scroll spiral wall and/or a fixed scroll spiral wall for a scroll type compressor is relatively large, a relieving part is formed for relieving the heat deformation of the movable scroll spiral wall and/or the fixed scroll spiral wall in at least a part of at least one of an outer circumferential wall of the movable scroll spiral wall and an inner circumferential wall of the fixed scroll spiral wall, which corresponds to the outer circumferential wall of the movable scroll spiral wall.

7 Claims, 3 Drawing Sheets

SCROLL TYPE COMPRESSOR

BACKGROUND OF THE INVENTION

The present invention relates to a scroll type compressor, which supplies compressed gas to an electrode of a fuel cell.

Japanese Unexamined Patent Publication 11-257259 discloses such a scroll type compressor. The scroll type compressor includes a movable scroll member, a fixed scroll member, an inlet and outlet. The movable scroll member has a movable scroll base plate and a movable scroll spiral wall that extends from the movable scroll base plate. The fixed scroll member has a fixed scroll base plate and a fixed scroll spiral wall that extends from the fixed scroll base plate. The movable scroll spiral wall and the fixed scroll spiral wall are engaged with each other to form a compression region between the movable scroll member and the fixed scroll member. The inlet is formed on the fixed scroll spiral wall side, which is an outside of the movable scroll spiral wall, and the outlet is formed in the middle of the fixed scroll base plate therethrough. When temperature in the compression region becomes relatively high, the movable scroll spiral wall and the fixed scroll spiral wall as a whole expand respectively in radial directions of the movable scroll base plate and the fixed scroll base plate. In the scroll type compressor, on one hand, since the outer circumferential side of the fixed scroll spiral wall, which is located near the inlet, is directly cooled by intake gas, the fixed scroll spiral wall in itself is partially maintained at relatively low temperature. On the other hand, the movable scroll spiral wall in itself, which is located inside of the fixed scroll spiral wall, is maintained at relatively high temperature by heat of compression.

Therefore, an amount of deformation of the movable scroll spiral wall becomes larger than that of the fixed scroll spiral wall. For this reason, it is highly expected that an outer circumferential wall of the movable scroll spiral wall comes in contact with an inner circumferential wall of the fixed scroll spiral wall.

To prevent the contact between the movable scroll spiral wall and the fixed scroll spiral wall by avoiding the partial differential in thermal expansion, in the above prior art, thickness of at least one of the movable scroll spiral wall and the fixed scroll spiral wall, which are placed near the inlet, is reduced.

Meanwhile, in the scroll type compressor, which supplies the compressed gas to the electrode of the fuel cell, the movable scroll base plate has a relatively large diameter. Also, a plurality of cylindrical driven crankshaft receiving portions with a bottom, which has a relatively large thickness, is placed on the back surface of the movable scroll base plate. A part of the movable scroll base plate, where the driven crankshaft receiving portions are placed, has a larger rigidity than a part of the movable scroll base plate, where the driven crankshaft receiving portion is not placed.

In the part of the movable scroll base plate, which has a relatively large rigidity, the deformation of the part of the movable scroll base plate caused by the thermal expansion is restrained. In other words, in the part of the movable scroll base plate, where the driven crankshaft receiving portion is placed, the deformation of the part of the movable scroll spiral wall is restrained. In contrast, in the part of the movable scroll base plate, where the driven crankshaft receiving portion is not placed, since the deformation of the part of the movable scroll base plate, where the driven crankshaft receiving portion is placed, is restrained, the deformation of the part of the movable scroll spiral wall, where the driven crankshaft receiving portion is not-placed, is promoted. For this reason, in the part of the movable scroll base plate, where the driven crankshaft receiving portion is not placed, it is highly expected that the outer circumferential wall of the movable scroll spiral wall strongly comes in contact with the inner circumferential wall of the fixed scroll spiral wall. In this case, however, the part where the movable scroll spiral wall is deformed is not only near the inlet as described in the above prior art. Therefore, in a manner that the thickness of at least one of the parts of the movable scroll spiral wall and the fixed scroll spiral wall, which are placed near the inlet, is reduced as described in the prior art, it is difficult to prevent the movable scroll spiral wall and the fixed scroll spiral wall from strongly coming in contact with each other. Thereby, reduction of the durability caused due to the contact, increase of the sliding loss, and increase of the sound level and vibration level are concerned.

SUMMARY OF THE INVENTION

The present invention is directed to a scroll type compressor that reduces sliding loss, sound level and vibration level and that improves durability by preventing a surface of a part of a scroll spiral wall where heat deformation is relatively large due to a difference in rigidity on a scroll base plate from strongly coming in contact with an opposing surface.

The present invention has the following features. A scroll type compressor includes a fixed scroll member, a movable scroll member, a drive crank mechanism and a plurality of driven crank mechanisms. The fixed scroll member has a fixed scroll base plate and a fixed scroll spiral wall that extends from the fixed scroll base plate. The movable scroll member has a movable scroll base plate and a movable scroll spiral wall that extends from the movable scroll base plate. The movable scroll spiral wall and the fixed scroll spiral wall are engaged with each other to form a compression region between the movable scroll member and the fixed scroll member. The drive crank mechanism is placed substantially in the middle of the movable scroll base plate. The movable scroll member orbits relative to the fixed scroll member. Thereby, fluid in the compression region is compressed. A plurality of driven crank mechanisms is annularly placed on a back surface of the movable scroll base plate. Each driven crank mechanism has a driven crankshaft receiving portion. When segments are drawn from a center of the movable scroll base plate so as to come in contact with respective driven crankshaft receiving portions and intersect with an outer circumference of the movable scroll base plate on a back surface of the movable scroll member, the driven crankshaft receiving portions, which are located next to each other, sandwich two of the segments. The two segments and an arc of the outer circumference of the movable scroll base plate define a first region, where a relieving part is formed in at least a part of at least one of an outer circumferential wall of the movable scroll spiral wall and an inner circumferential wall of the fixed scroll spiral wall, which corresponds to the outer circumferential wall of the movable scroll spiral wall. The relieving part relieves heat deformation of the movable scroll spiral wall and/or the fixed scroll spiral wall.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
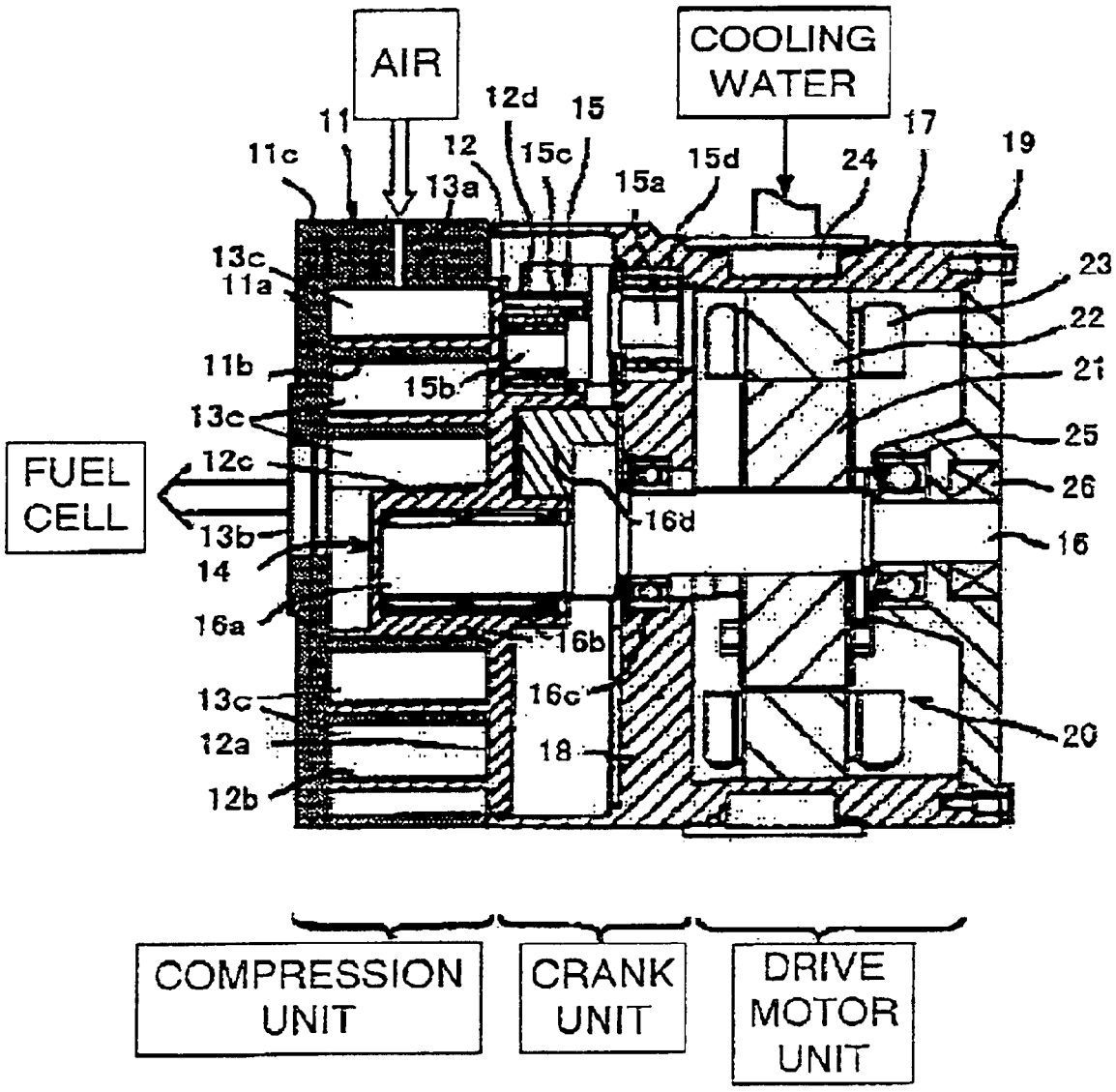
FIG. 1 is a longitudinal sectional view illustrating a scroll type compressor for a fuel cell according to a preferred embodiment of the present invention.

A scroll type compressor according to a preferred embodiment of the present invention will now be described with reference to FIG. 1. The scroll type compressor sends air to an oxygen electrode of a fuel cell. The scroll type compressor also includes a compression unit, a crank unit and a drive motor unit. In FIG. 1, a left side of the drawing is front and a right side thereof is rear.

Referring to FIG. 1, the compression unit includes a fixed scroll member 11 and a movable scroll member 12. The fixed scroll member 11 has a disk-like fixed scroll base plate 11*a*, a fixed scroll spiral wall 11*b* that extends from the fixed scroll base plate 11*a*, and an outermost fixed scroll circumferential wall 11*c* that surrounds the fixed scroll spiral wall 11*b*. The fixed scroll base plate 11*a* and the outermost fixed scroll circumferential wall 11*c* form a front housing. An inlet 13*a*, through which air is introduced, extends through a circumferential wall of the front housing. Also, an outlet 13*b* is formed substantially in the middle of the fixed scroll base plate 11*a* and connects with the oxygen electrode of the fuel cell through a pipe, although the oxygen electrode and the pipe are not illustrated in the drawing.

Still referring to FIG. 1, the movable scroll member 12 also has a disk-like movable scroll base plate 12*a* and a movable scroll spiral wall 12*b* that extends from the movable scroll base plate 12*a*. The fixed scroll spiral wall 11*b* is engaged with the movable scroll spiral wall 12*b* to form a compression region 13*c* between the fixed scroll member 11 and the movable scroll member 12. A cylindrical drive crankshaft receiving portion 12*c* extends in the middle of the movable scroll base plate 12*a*. The drive crankshaft receiving portion 12*c* has a bottom at a front side thereof and receives a drive crankpin 16*a* of a drive shaft 16. On the outer circumferential side of the drive crankshaft receiving portion 12*c*, three cylindrical driven crankshaft receiving portions 12*d* that extend from the rear surface of the movable scroll base plate 12*a* are placed at equal intervals in a circumferential direction of the movable scroll base plate 12*a*. The driven crankshaft receiving portions 12*d* each have a bottom on a rear surface thereof. Each driven crankshaft receiving portion 12*d* receives a driven crankpin 15*a*.

The crank unit includes a drive crank mechanism 14 and a driven crank mechanism 15. The drive crank mechanism 14 is placed substantially in the middle of the movable scroll base plate 12*a* for orbiting the movable scroll member 12 relative to the fixed scroll member 11 so as to compress fluid in the compression region 13*c*. The driven crank mechanism 15 prevents the movable scroll member 12 from rotating relative to the movable scroll member 12 in itself. The drive crank mechanism 14 includes the drive crankshaft receiving portion 12*c*, the drive crankpin 16*a* and a roller bearing 16*b*, which supports the drive crankpin 16*a* for rotation.

The drive shaft 16 is supported for rotation at the front side thereof by a radial bail bearing 16*c* while supported substantially in the middle of a rear housing 19 for rotation, which will be described later, by a radial ball bearing 25. In addition, a clearance between the drive shaft 16 and a through hole formed in the middle of the rear housing 19 is sealed by a seal 26. While the movable scroll member 12 orbits, moment of inertia is generated. To cancel the moment, a balance weight 16*d* is mounted on the drive shaft 16. Thereby, vibration of the drive shaft 16 is restrained.

Also, the driven crank mechanism 15 includes the above-mentioned driven crankshaft receiving portion 12*d*, a driven crankpin 15*b* of the driven crankshaft 15*a* and a radial ball bearing 15*c*, which supports the driven crankpin 15*b* for rotation. The driven crankshaft 15*a* is supported for rotation by a double row ball bearing 15*d* at the rear side thereof.

The crank unit is accommodated in a center housing 17 with the drive motor unit, which will be described later. A support frame 18 is integrally formed with the center housing 17 substantially in the middle of the center housing 17. The support frame 18 partitions the center housing 17 into the crank unit and the drive motor unit. Furthermore, the ball bearings 16*c* and 15*d* are fitted in the support frame 18.

The drive motor unit includes a drive motor 20, which is surrounded by the center housing 17, the rear housing 19 and the support frame 18. The drive motor 20 includes the drive shaft 16, a rotor 21 and a stator 22. The drive shaft 16 extends through the middle of the drive motor 20. The rotor 21 is fitted around the drive shaft 16. The stator 22 is placed at the outer circumferential side of the rotor 21 and is wound by a coil 23. That is, the drive motor 20 is an induction motor. Therefore, the number of rotations of the drive motor 20 is controlled by an inverter, which is not shown in FIG. 1. The rear housing 19 and the center housing 17 are bolted by a plurality of bolts at the rear end of the drive motor 20. Thereby, a motor chamber is defined therebetween. Furthermore, a water racket 24 is formed on the center housing 17, which covers the drive motor 20, so as to correspond to the stator 22. Therefore, the drive motor 20 is cooled by cooling water.

When electricity is supplied to the drive motor 23, the drive shaft 16 rotates. Thereby, the drive shaft 16 orbits the movable scroll member 12 relative to the fixed scroll member 11 through the drive crank mechanism 14. At this time, air or fluid is introduced into the compression region 13*c* formed between the fixed scroll member it and the movable scroll member 12 through the inlet 13*a*. During the orbital movement of the movable scroll member 12, the introduced air is compressed in the compression region 13*c* to a predetermined pressure value and is discharged through the outlet 13*b*. Thus, the compressed air is supplied to the oxygen electrode of the fuel cell.

Figure 2A:
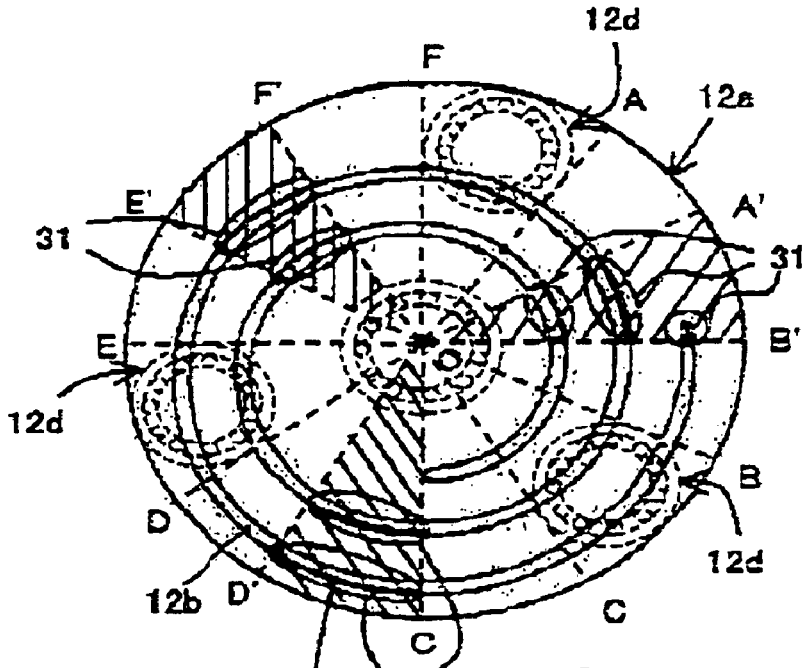
FIG. 2A is a plane view illustrating a movable scroll member for use in the scroll type compressor according to the preferred embodiment of the present invention.

Now, the structure of the movable scroll member 12 will be described in detail with reference to FIGS. 2A and 2B. Referring to FIG. 2A, a plane view of the movable scroll member 12 of FIG. 1 is illustrated. Also, referring to FIG. 2B, a recess 32 is formed on the movable scroll spiral wall 12*b* of the movable scroll member 12. The ends of the recess 32 in a circumferential direction of the movable scroll spiral wall 12*b* each have an angular shape.

While the scroll type compressor is driven, as fluid in the compression region 13*c* is moved toward a center O of the movable scroll base plate 12*a*, temperature and pressure of the fluid rises. Therefore, the movable scroll spiral wall 12*b* of the movable scroll member 12 expands outwardly in a radial direction of the movable scroll base plate 12*a*.

Meanwhile, when the driven crankshaft receiving portion 12*d*, which extends from the rear surface of the movable scroll base plate 12*a*, is relatively thick, however, rigidity becomes unequal on the movable scroll base plate 12*a*. That is, rigidity of a part of the rear surface of the movable scroll base plate 12*a*, where the driven crankshaft receiving portion 12*d* is placed, becomes higher than that of a part of the rear surface of the movable scroll base plate 12*a*, where the driven crankshaft receiving portion 12*d* is not placed. When the rigidity of the movable scroll base plate 12*a* is relatively high, heat deformation of the movable scroll spiral wall 12*b* is restrained. On the contrary, when the rigidity of the movable scroll base plate 12*a* is relatively low, in other word, in the part of the rear surface of the movable scroll base plate 12*a*, where the driven crankshaft receiving portion 12*d* is not placed, an amount of the heat deformation of the movable scroll spiral wall 12*b* is increased by the restrained amount of heat deformation of the part of the rear surface of the movable scroll spiral wall 12*b*, where the driven crankshaft receiving portion 12*d* is placed.

Referring back to FIG. 2A, a shaded region indicates a region of the movable scroll base plate 12*a* where the amount of the heat deformation of the movable scroll spiral wall 12*b* is maximized due to the unequalness of the rigidity on the movable scroll base plate 12*a*. Specifically, the shaded region is defined as follows. Segments (OA, OB, . . . , OF) are drawn from the center O of the movable scroll base plate 12*a* so as to come in contact with the respective driven crankshaft receiving portions 12*d* and intersect with the outer circumference of the movable scroll base plate 12*a* on a back surface of the movable scroll member 12. A first region (sectors OAB, OCD, OEF) is defined by the segments and an arc of the outer circumference of the movable scroll base plate 12*a* between the driven crankshaft receiving portions 12*d*, which are next to each other. Furthermore, in the sector OAB of the first region, segments (OA', OB') are drawn from the center O of the movable scroll base plate 12*a* in a radial direction of the movable scroll base plate 12*a* so as to substantially divide the sector OAB into three equal parts (sectors OAA', OA'B', OB'B). In this case, an angle of AOA', an angle of A'OB' and an angle of B'OB are equal to each other. In the sectors OAA', OA'B', OB'B, a second region which includes a middle point of arc AB sandwiched by the driven crankshaft receiving portions 12*d*, that is, the sector OA'B' is the shaded region. In a similar manner, the second region includes sectors OC'D', OE'F'. That is, the sectors OC'D', OE'F' are also the shaded region.

Still referring to FIG. 2A, a part 31 of the movable scroll spiral wall 12*b* in the shaded region is marked with a circle. A relieving part according to the present invention is formed on the outer circumferential wall of the part 31 of the movable scroll spiral wall 12*b*. Referring to FIG. 2B, the recess 32 serves as the relieving part.

Figure 2B:
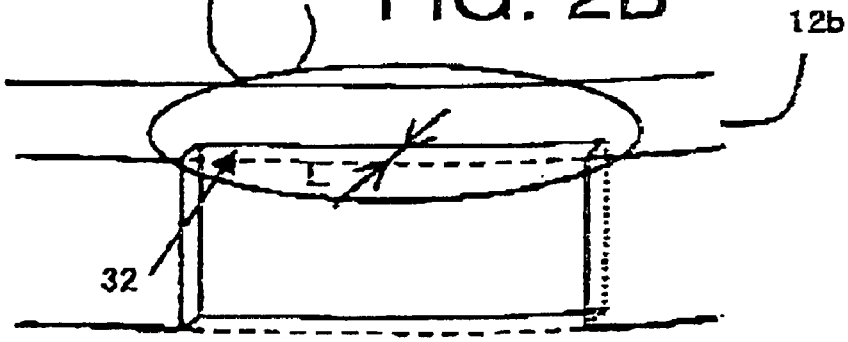
FIG. 2B is a partially enlarged perspective view illustrating a relieving part of a movable scroll spiral wall of the movable scroll member for use in the scroll type compressor according to the preferred embodiment of the present invention.

Referring to FIG. 2B, a relieving length L of the recess 32 indicates a depth of the recess 32. The relieving length L of the recess 32 is found approximately in a range of 20 $\mu$m to 100 $\mu$m inclusive. This is because a relatively strong contact between the fixed scroll spiral wall 11*b* and the movable scroll spiral wall 12*b* is not prevented if the range falls short of 20 $\mu$m. This is also because once compressed fluid leaks into a compression region whose pressure is relatively low through the relieving part and efficiency of compression of the compressor is deteriorated if the range exceeds 100 $\mu$m.

It is predicted that the heat deformation of the movable scroll spiral wall 12*b* is generated over an extending direction of the movable scroll spiral wall 12*b*. Therefore, the recess 32, which serves as the relieving part, is formed over the extending direction of the movable scroll spiral wall 12*b*.

In the above-described preferred embodiment, the following effects are obtained. In the scroll type compressor, a relatively strong contact between the fixed scroll spiral wall 11*b* and the movable scroll spiral wall 12*b* is prevented. Thereby, sliding loss, sound level and vibration level of the fixed scroll spiral wall 11*b* and the movable scroll spiral wall 12*b* are reduced. Thus, durability of the fixed scroll spiral wall 11*b* and the movable scroll spiral wall 12*b* is improved. Furthermore, since the only part of the movable scroll base plate 12*a* where the amount of the heat deformation of the movable scroll spiral wall 12*b* is maximized is relieved, a machining cost for forming a relieving part is restrained.

In the present invention, the following alternative embodiments are also practiced.

Figure 3A:
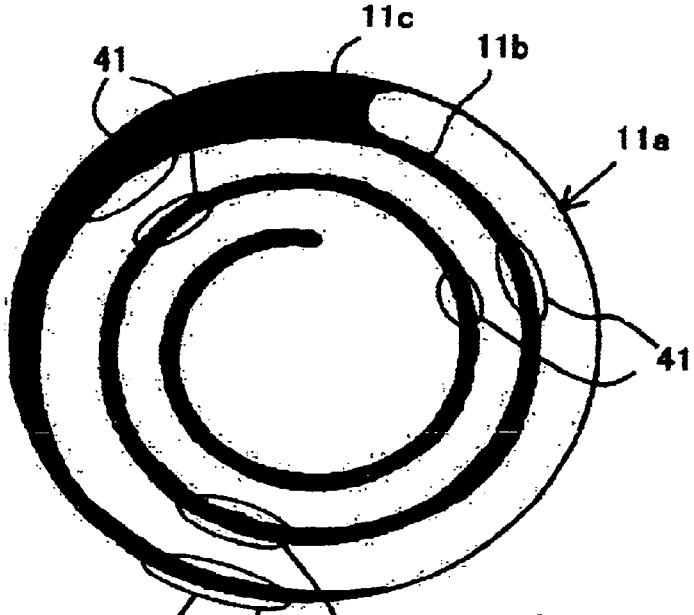
FIG. 3A is a plane view illustrating a fixed scroll member for use in a scroll type compressor according to yet another embodiment of the present invention.
Figure 3B:
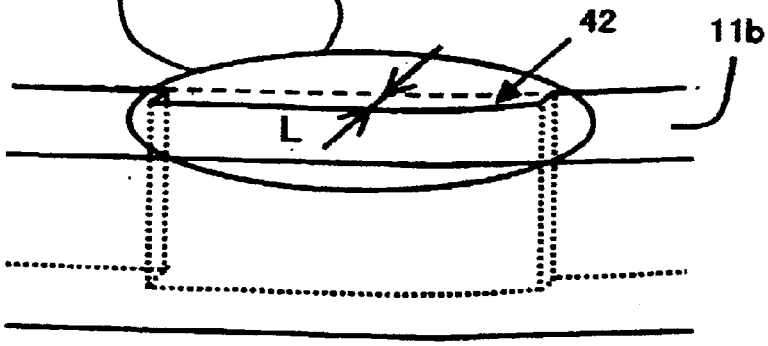
FIG. 3B is a partially enlarged perspective view illustrating a relieving part of a fixed scroll spiral wall for use in a scroll type compressor according to yet another embodiment of the present invention.

In the above-described embodiment, the recess 32 is formed in the outer circumferential surface of the movable scroll spiral wall 12*b*. In alternative embodiments to the preferred embodiment, as shown in FIGS. 3A and 3B, the recess 32 is not formed in the outer circumferential surface of the movable scroll spiral wall 12*b* but a recess 42 is formed in the inner circumferential surface of the fixed scroll spiral wall 11*b*. In the other aspects, a scroll type compressor according to the present embodiment of the present invention is structurally same as the scroll type compressor according to the above-described preferred embodiment of the present invention. Therefore, constituent components common to the preferred embodiment are added with the same reference numeral in FIGS. 3A and 3B, and overlap of explanation is omitted. FIG. 3A is a plane view illustrating the fixed scroll spiral wall 11*b* as seen from the rear surface of the fixed scroll base plate 11*a*. Referring to FIG. 3B, the recess 42 serves as a relieving part.

In the scroll type compressor, the movable scroll member 12 orbits relative to the fixed scroll member 11. In other words, the first region and the second region in themselves orbit relative to the fixed scroll member 11. Therefore, parts of the fixed scroll spiral wall 11*b*, which respectively correspond to the first region and the second region of the movable scroll base plate 12*a*, are not directly defined. However, contact between the fixed scroll spiral wall 11*b* and the movable scroll spiral wall 12*b* is at a one-to-one correspondence. Therefore, if the first region and the second region are defined on the movable scroll base plate 12*a*, in other words, if a range of the relieving part is defined on the movable scroll spiral wall 12*b*, the corresponding range of the relieving part is univocally defined on the fixed scroll spiral wall 11*b*. Specifically, as shown in FIG. 3A, in the present embodiment, a part 41 of the fixed scroll spiral wall 11*b* is marked with a circle. The part 41 of the fixed scroll spiral wall 11*b*, where the relieving part is formed, corresponds to the part 31 of the movable scroll spiral wall 12*b* according to the above-described preferred embodiment, where the relieving part is formed. A relieving part according to the present invention is formed on the inner circumferential wall of the part 41 of the fixed scroll spiral wall 11*b*.

Referring to FIG. 3B, a relieving length L of the recess 42 indicates a depth of the recess 42. The relieving length L of the recess 42 of the fixed scroll spiral wall 11*b* is formed so as to range approximately from 20 $\mu$m to 100 $\mu$m inclusive in a similar manner that the relieving length L of the recess 32 of the movable scroll spiral wall 12*b* is formed. The recess 42 is formed over an extending direction of the fixed scroll spiral wall 11*b*.

In the present embodiment, the similar effects to the effects of the above-described preferred embodiment are obtained.

In the above-described embodiments, the range of the relieving part is limited to that of the second region. In alternative embodiments to the embodiments, however, a recess, which serves as a relieving part, is formed in at least a part of the range of the first region. In the present embodiment, sliding loss, sound level and vibration level of the fixed scroll spiral wall 11*b* and the movable scroll spiral wall 12*b* are also reduced. Therefore, durability of the fixed scroll spiral wall 11*b* and/or the movable scroll spiral wall 12*b* is improved.

Figure 2C:
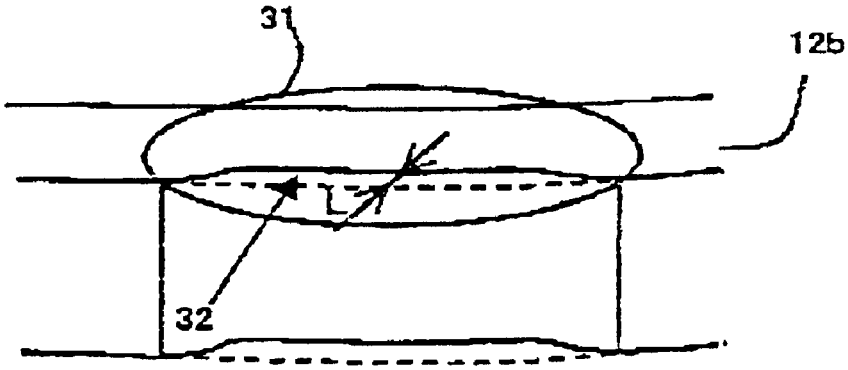
FIG. 2C is a partially enlarged perspective view illustrating a relieving part of a movable scroll spiral waif of a movable scroll member for use in a scroll type compressor according to another embodiment of the present invention.
Figure 3C:
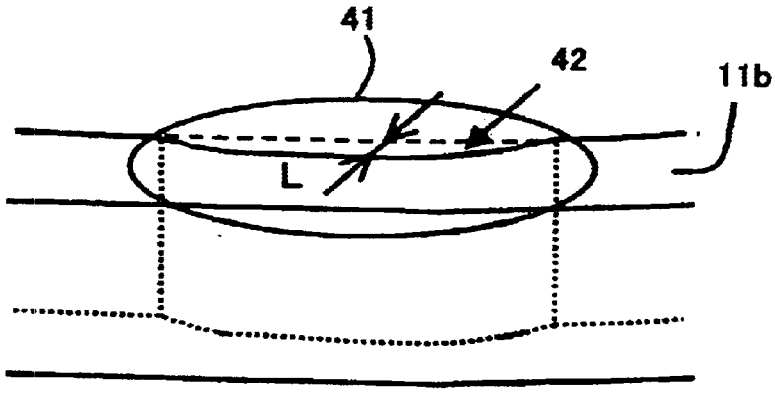
FIG. 3C is a partially enlarged perspective view illustrating a relieving part of a fixed scroll spiral wall for use in a scroll type compressor according to yet another embodiment of the present invention.

In the above-described embodiments, the ends of the recess 32 in a circumferential direction of the movable scroll spiral wall 12*b* each have an angular shape as shown in FIG. 2B. In a similar manner, the ends of the recess 42 in a circumferential direction of the fixed scroll spiral wall 11*b* each have an angular shape as shown in FIG. 3B. In alternative embodiments to the embodiments, however, the ends of the recess 32 in the circumferential direction of the movable scroll spiral wall 12*b* wall 11*b* each have a round shape as shown in FIG. 2C. In a similar manner, the ends of the recess 42 in the circumferential direction of the fixed scroll spiral wall 11*b* each have a round shape as shown in FIG. 3C.

In the above-described embodiments, the present invention is applied to one of the movable scroll spiral wall 12*b* and the fixed scroll spiral wall 11*b*. In alternative embodiments to the embodiments, the relieving part is formed on both the movable scroll spiral wail 12*b* and the fixed scroll spiral wall 11*b*. In this case, a relieving length of the relieving part of the movable scroll spiral wall 12*b* side and a relieving length of the relieving part of the fixed scroll spiral wail 11*b* side are all together formed so as to range approximately from 20 $\mu$m to 100 $\mu$m inclusive.

In the above-described embodiments, the present invention is applied to a scroll type compressor for a fuel cell. In alternative embodiments to the embodiments, however, the present invention is applied to a refrigerant scroll type compressor for an air conditioning system, which has a driven crank mechanism on a back surface of the movable scroll base plate 12*a*.

In the above-described embodiments, the number of the driven crank mechanisms is three. In alternative embodiments to the embodiments, however, the number of the driven crank mechanisms is four or more than four.

Therefore, the present examples and embodiments are to be considered as illustrative and not restrictive and the invention is not to be limited to the details given herein but may be modified within the scope of the appended claims.

What is claimed is:

1. A scroll type compressor comprising:

a fixed scroll member having a fixed scroll base plate and a fixed scroll spiral wall that extends from the fixed scroll base plate;

a movable scroll member having a movable scroll base plate and a movable scroll spiral wall that extends from the movable scroll base plate, the movable scroll spiral wall and the fixed scroll spiral wall being engaged with each other to form a compression region between the movable scroll member and the fixed scroll member;

a drive crank mechanism placed substantially in the middle of the movable scroll base plate for orbiting the movable scroll member relative to the fixed scroll member to compress fluid in the compression region; and a plurality of driven crank mechanisms annularly placed on a back surface of the movable scroll base plate, each driven crank mechanism having a driven crankshaft receiving portion;

wherein when segments are drawn from a center of the movable scroll base plate so as to come in contact with respective driven crankshaft receiving portions and intersect with an outer circumference of the movable scroll base plate on a back surface of the movable scroll member, the driven crankshaft receiving portions, which are located next to each other sandwiching two of the segments, the two segments and an arc of the outer circumference of the movable scroll base plate defining a first region, where a relieving part is formed in at least a part of at least one of an outer circumferential wall of the movable scroll spiral wall and an inner circumferential wall of the fixed scroll spiral wall, which corresponds to the outer circumferential wall of the movable scroll spiral wall, for relieving heat deformation of the movable scroll spiral wall and/or the fixed scroll spiral wall.

2. The scroll type compressor according to claim 1, wherein when the first region is substantially divided into three equal parts by drawing a line from the center of the movable scroll base plate in a radial direction of the movable scroll base plate, the part of the first region which includes a middle point of the arc of the first region being defined as a second region, where the relieving part is formed in at least one of the outer circumferential wall of the movable scroll spiral wall and an inner circumferential wall of the fixed scroll spiral wall, which corresponds to the outer circumferential wall of the movable scroll spiral wall.

3. The scroll type compressor according to claim 1, wherein the relieving part is provided by forming a recess in the movable scroll spiral wall and/or the fixed scroll spiral wall over an extending direction of the movable scroll spiral wall and/or the fixed scroll spiral wall.

4. The scroll type compressor according to claim 3, wherein a relieving length of the recess ranges from 20 $\mu$m to 100 $\mu$m inclusive.

5. The scroll type compressor according to claim 3, wherein ends of the recess in a circumferential direction of the movable scroll spiral wall and/or the fixed scroll spiral wall each have an angular shape.

6. The scroll type compressor according to claim 3, wherein ends of the recess in a circumferential direction of the movable scroll spiral wall and/or the fixed scroll spiral wall each have a round shape.

7. The scroll type compressor according to claim 1, wherein the compressor supplies compressed gas to an electrode of a fuel cell.

* * * * *